United States Patent [19]

Tateda

[11] 4,137,442

[45] Jan. 30, 1979

[54] HIGH-FREQUENCY OVEN HAVING A BROWNING UNIT

[75] Inventor: Koichi Tateda, Yao, Japan

[73] Assignee: Sharp Kabushiki Kaisha, Osaka, Japan

[21] Appl. No.: 833,652

[22] Filed: Sep. 15, 1977

[30] Foreign Application Priority Data

May 24, 1974 [JP] Japan ..... 49-59028

Related U.S. Application Data

[63] Continuation of Ser. No. 579,917, May 22, 1975, abandoned.

[51] Int. Cl.[2] ..... H05B 9/06

[52] U.S. Cl. ..... 219/10.55 B; 126/332; 219/10.55 D; 219/10.55 F

[58] Field of Search ..... 219/10.55 B, 10.55 D, 219/10.55 F, 10.55 E, 402, 403, 404, 405, 409, 411, 413; 126/337 R, 337 A, 332

[56] References Cited

U.S. PATENT DOCUMENTS

| | | | |
|---|---|---|---|
| 2,984,730 | 5/1961 | Ostrom et al. | 219/404 X |
| 3,177,334 | 4/1965 | Kinkle | 219/10.55 D |
| 3,281,575 | 10/1966 | Ferguson, Jr. | 219/404 |
| 3,320,396 | 5/1967 | Boehm | 219/10.55 E |
| 3,377,562 | 4/1968 | Staats | 219/10.55 F X |
| 3,523,181 | 8/1970 | Beasley | 219/404 |
| 3,569,656 | 3/1971 | White et al. | 219/10.55 B |
| 3,582,598 | 6/1971 | Wincott | 219/10.55 D |
| 3,668,357 | 6/1972 | Kobayashi | 219/10.55 D |
| 3,783,219 | 1/1974 | Tateda | 219/10.55 D |
| 3,878,350 | 4/1975 | Takagi | 219/10.55 E |

*Primary Examiner*—Arthur T. Grimley

*Attorney, Agent, or Firm*—Birch, Stewart, Kolasch and Birch

[57] ABSTRACT

A browning unit is slidably provided in a high-frequency oven cavity. The browning unit is adjustable in location in the oven cavity with the use of a lever provided on an outside wall of the oven for controlling a browning or toasting condition of the exterior of foodstuffs. To prevent leakage of high-frequency energy, a choke mechanism is required at a point through which a lead wire and a supporter for the browning unit are provided.

4 Claims, 10 Drawing Figures

HIGH-FREQUENCY OVEN HAVING A BROWNING UNIT

This application is a continuation of copending application Ser. No. 579,917 filed on May 22, 1975 now abandoned.

BACKGROUND OF THE INVENTION

The present invention relates to a high-frequency oven capable of browning or toasting the exterior of foodstuffs and, more particularly, to a high-frequency oven having a browning unit slidable upwardly and downwardly in a high-frequency oven cavity.

A high-frequency oven in general dielectrically heats foodstuffs contained therein by radiating microwaves. Exothermic effects can be obtained in the almost entire body of the foodstuffs, but the exterior of the foodstuffs can not be browned or toasted since the exterior of which is not heated, which is contrary to a radiant heating.

Some kinds of foodstuffs are unavoidably worse in their taste and external appearances when cooked in a high-frequency oven in comparison with foodstuffs cooked by other cooking methods of the prior art, since the exterior of the foodstuffs cannot be browned.

In order to avoid the above-mentioned defectives, it has been proposed to provide a radiant heater such as an electric heater, a gas heater and an infrared heater to a high-frequency oven cavity. A high-frequency oven having an electric heater therein is shown in, for example, U.S. Pat. Nos. 2,831,952 and 3,081,392. The radiant heater of the prior art was fixed at a certain position in a high-frequency oven cavity and, therefore, it was impossible to uniformly brown the exterior of the foodstuffs or to control the browning at a desired magnitude.

OBJECTS AND SUMMARY OF THE INVENTION

Accordingly, an object of the present invention is to provide a high-frequency oven having a novel browning unit.

Another object of the present invention is to provide a browning unit slidable upwardly or downwardly in a high-frequency oven cavity.

Still another object of the present invention is to provide a browning unit of which the location in a high-frequency oven cavity is adjustable with the use of a lever provided on an outside wall of the high-frequency oven.

Yet another object of the present invention is to provide a ventilating system suitable for cooling a high-frequency oven cavity including a browning unit therein.

A further object of the present invention is to provide a support mechanism for movably supporting a browning unit in a high-frequency oven cavity.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above objectives, pursuant to the present invention, a browning unit is slidably supported by a supporting mechanism in a high-frequency oven cavity in order to control a browning or toasting condition of the exterior of foodstuffs. The browning unit is adjustable in height in the oven cavity with the use of a lever provided on an outside wall of the oven. A lead wire and the supporting mechanism for the browning unit are provided through a wall of the oven cavity at which a choke mechanism is provided for preventing leakage of high-frequency energy.

A cooling fan is provided for cooling a magnetron useful for the microwave cooking. A portion of the air flow caused by the cooking fan is conducted into the oven cavity in order to prevent unnecessary temperature rise near the browning unit, and then conducted to the outside of the oven by virtue of venturi effect cause by a major portion of the air flow created by the cooling fan.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DESCRIPTION OF THE PREFERRED EMBODIMENTS

Figure 1:
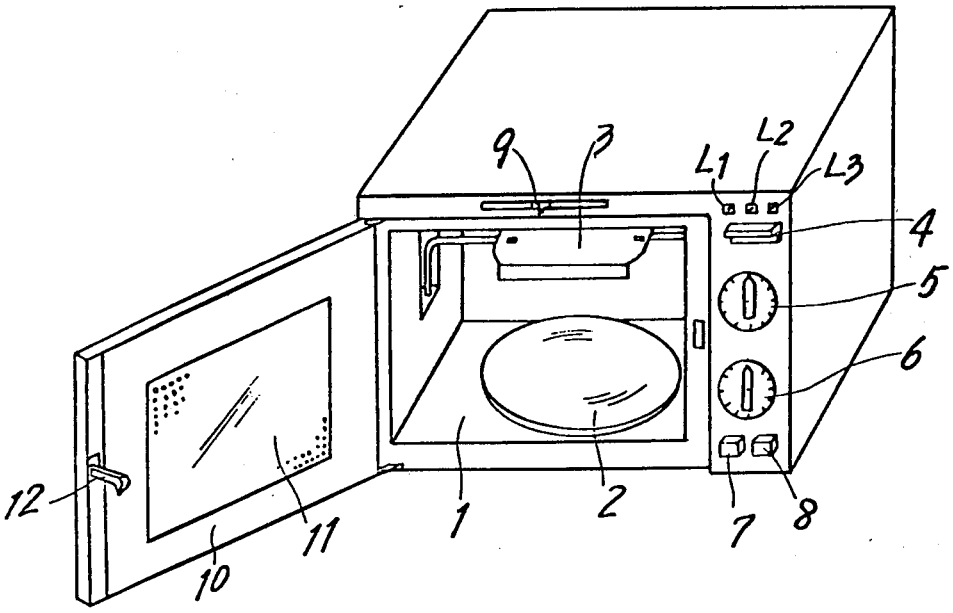
FIG. 1 is a perspective view of a high-frequency oven of the present invention.

Referring now to FIG. 1, the illustrated embodiment of the present invention comprises an oven cavity 1, a turntable 2 rotatably provided is the lower region of the oven cavity 1 and upon which foodstuffs are mounted, and a browning unit 3 provided in the upper region of the oven cavity, the detailed construction of the browning unit 3 being described later.

An opening lever 4 is provided for locking and unlocking the opening of a door 10 of the high-frequency oven. An operation panel includes a cook timer 5 for determining a microwave heating time period, a browner timer 6 for determining a radiant heating time period, a cook switch 7 for generating a cooking initiation command, and a defrost control switch 8 for intermittently operating a magnetron, the intermittent operation being suitable for defrosting frozen foodstuffs. A slidable lever 9 is provided on the upper part of a front panel with the use of clearance between the upper wall of the oven cavity 1 and the outside wall of the high-frequency apparatus. The browning unit 3 is adjustable in height in the oven cavity 1 with the use of the slidable lever 9, thereby changing distance between the browning unit 3 and the foodstuffs mounted on the turntable 2. The slide mechanism of the browning unit 3 will be described in detail later with reference to FIG. 6.

A punching 11 coated with a transparent plate made of, for example, glass or appropriate resin is provided in the center of the oven door 10 to enable the operator to observe the cooking operation therethrough. A locking knob 12 associated with the opening lever 4 is required to prevent an erroneous opening of the oven door 10. A cooking lamp $L_1$, a browner lamp $L_2$ and a defrost lamp $L_3$ are provided for indicating the respective operations.

Figure 2:
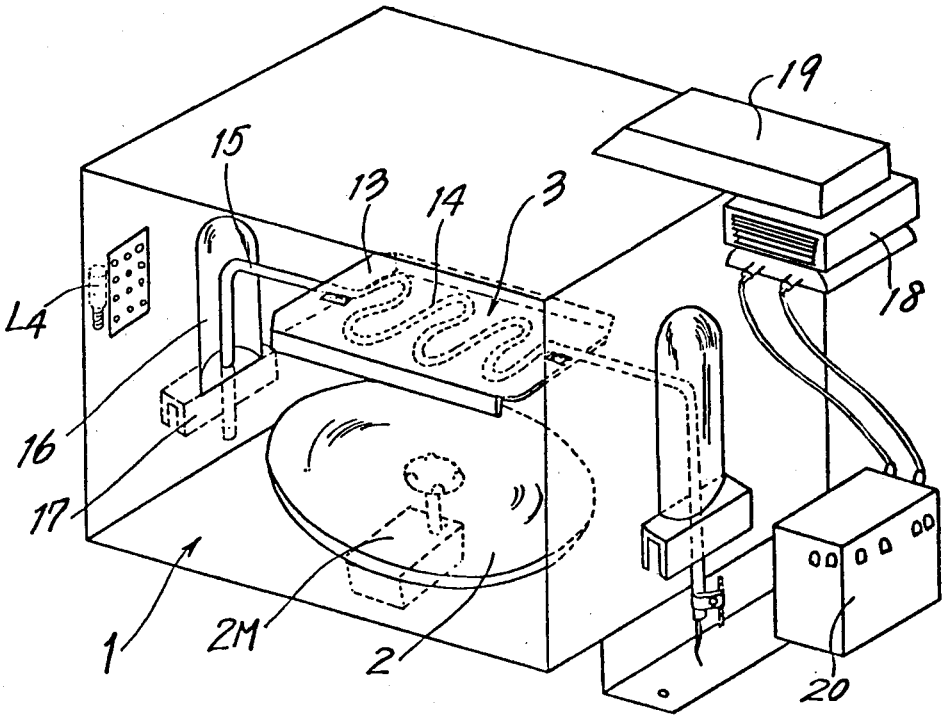
FIG. 2 is a perspective view of an essential part of the high-frequency oven of FIG. 1.

Referring now to FIG. 2, there is illustrated the essential elements of the high-frequency apparatus of the present invention, the oven cavity 1 is connected to receive high-frequency energy from a magnetron 18, which generate microwave of 2,450 MHz, via a waveguide 19. The magnetron 18 is connected with a transformer 20.

The turntable 2 provided in the lower region of the oven cavity 1 is supported for rotation by a driving mechanism at the central portion or periphery thereof, the driving mechanism being associated with the driving shaft of a motor 2M which is fixed outside of the oven cavity 1. The foodstuffs mounted on the turntable 2 change their location during the microwave cooking operation and the browning operation with the revolution of the turntable 2, thereby to ensure uniform heating.

The browning unit 3 comprises a reflector plate 13 and a heat generating means 14. The heat generating means 14 is made of the conventional sheath heater. The reflector plate 13 is made of metal having a mirror surface facing against the sheath heater 14. The reflector plate 13 functions to reflect the upwardly propagated radiant heat generated by the sheath heater 14 toward the foodstuffs. The surface of the reflector plate 13 is preferably coated with enamel to facilitate the cleaning of the reflector plate 13 upon which steam and oil may attach during the cooking operation. The metal reflector plate 13 can also reflect microwave radiated from the upper wall of the oven cavity 1 and, therefore, the reflector plate 13 is effective for performing the uniform heating since the microwave is radiated from the periphery of the reflector plate 13 to the oven cavity 1.

The location of the browning unit 3 is controlled with the use of a supporting pipe 15. An indent 16 is provided on the side wall of the oven cavity 1. The supporting pipe 15 is conducted to the outside of the oven cavity 1 through the bottom wall of the indent 16, at which a choke mechanism 17 is provided to prevent leakage of high-frequency energy. An illumination lamp $L_4$ is provided on the side wall of the oven cavity 1.

The browning unit 3 and the choke mechanism 17 will be described in detail with reference to FIG. 3. The heat generating means 14 is made of the sheath heater, as already discussed above, which comprises a sheath 23 made of conductive material, a heat generating resistance wire 21 provided through the sheath 23, and heat-proof insulating material 22 such as $Al_2O_3$ filled in the sheath 23, as is well known in the art. The sheath heater 14 is arranged in a serpentine fashion to increase the effective heat generating area. The reflector plate 13 includes a bent side wall **13*a* and a connection leaf 13*b*, at which the reflector plate 13 is fixed to the sheath heater 14 via a holder 24 and a screw 25**.

The sheath 23 has an extension constituting supporting pipe 15 and passes through the bottom wall of the indent 16 of the oven cavity 1. A lead wire 26 is provided through the sheath 23 for power supply to the heat generating resistance wire 21.

The sheath 23 of the supporting pipe 15 and of the heat generating means 14 can be fabricated either in a single body or in discrete components and then connected to each other in order to facilitate the fabrication of the browning unit 3. The lead wire 26 is covered with the conductive sheath 23 and, therefore, there is no possibility that the high-frequency energy may leak to the outside of the oven cavity 1 via the lead wire 26.

The supporting pipe 15 is provided at the both sides of the browning unit 3. The supporting pipes pass through the corresponding side walls of the oven cavity 1, at which the choke mechanism 17 is provided. The indent 16 is also provided at both of the corresponding side walls of the oven cavity 1 in order to prevent the reduction of the volume of the oven cavity 1.

The choke mechanism 17 comprises a metal block 27, an insulating bearing 28, a ring shaped plate 29 made of metal, and a metal cover plate 30 for fixing the insulating bearing 28 and the ring shaped plate 29 with respect to the metal block 27. The metal block 27 is inserted into an aperture C – C' provided at the bottom of the indent 16 and fixed to the oven cavity 1 with the use of the welding technology. The upper surface of the metal block 27, which forms the bottom wall of the indent 16, is so constructed to incline with respect to the oven cavity 1, thereby to facilitate the cleaning of the indent 16. The supporting pipe 15 is provided through the insulating bearing 28 made of Teflon and slidably supported by the insulating bearing 28 by virtue of frictional force.

Cylindrical clearance 31 is provided within the metal block 27. The length of the clearance 31 is substantially identical with $\lambda/4$ where the microwave has the wavelength of $\lambda$. The leakage of the microwave energy through the point at which the supporting pipe 15 passes through the oven cavity 1 can be prevented, since the choke mechanism 17 shows considerably high impedance against the microwave having the wavelength of $\lambda$.

The insulating bearing 28 functions not only to slidably support the supporting pipe 15 but also to serve as a spacer between the supporting pipe 15 and the metal block 27. Therefore, theinsulating bearing 28 prevent the occurrence of the arc discharge which will occur when the supporting pipe 15 comes into contact with the metal block 27 upon moving of the supporting pipe 15.

Figure 3:
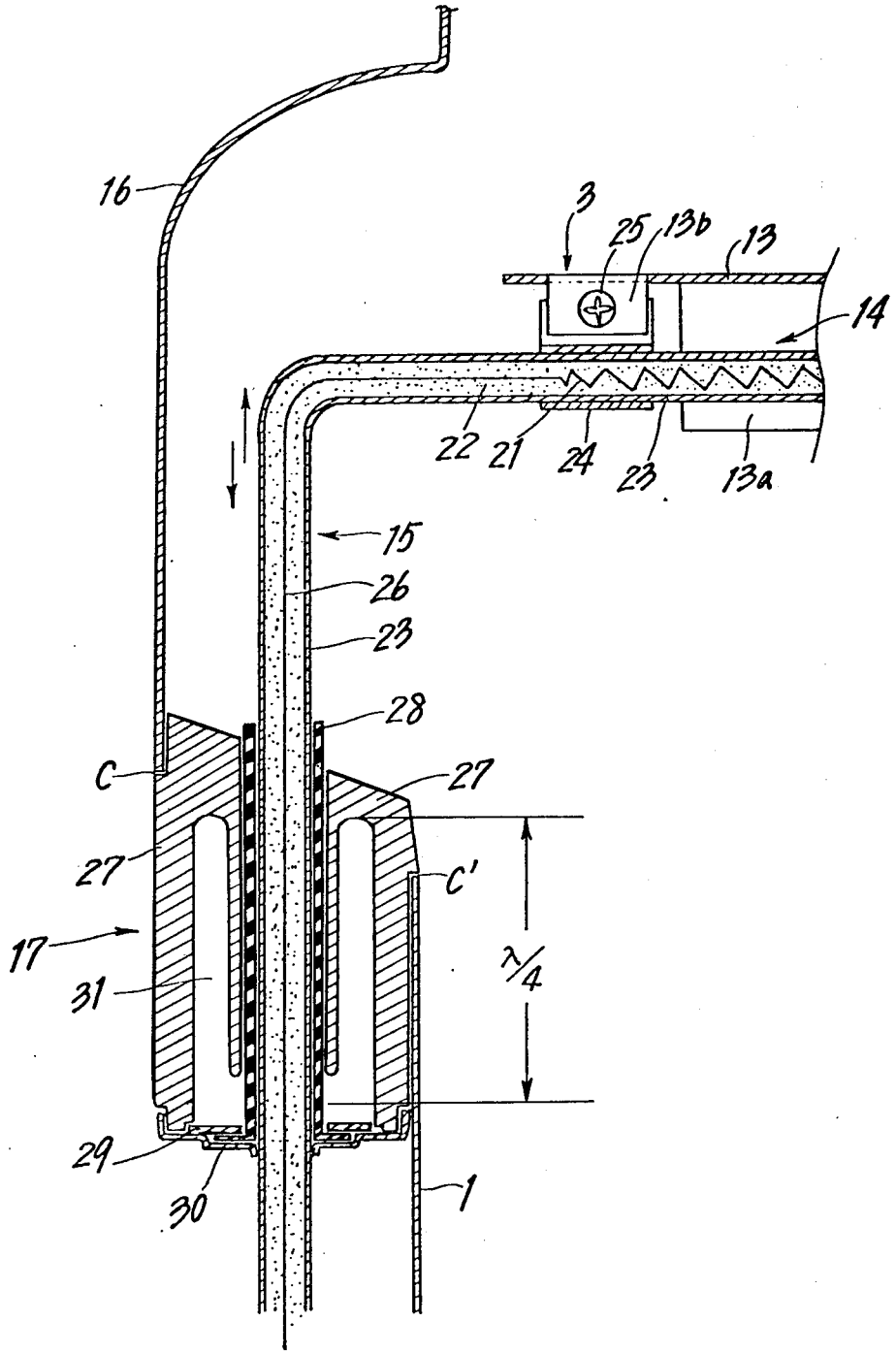
FIG. 3 is a sectional view of an embodiment of a leakage preventing mechanism suitable for the high-frequency oven of the present invention.
Figure 4:
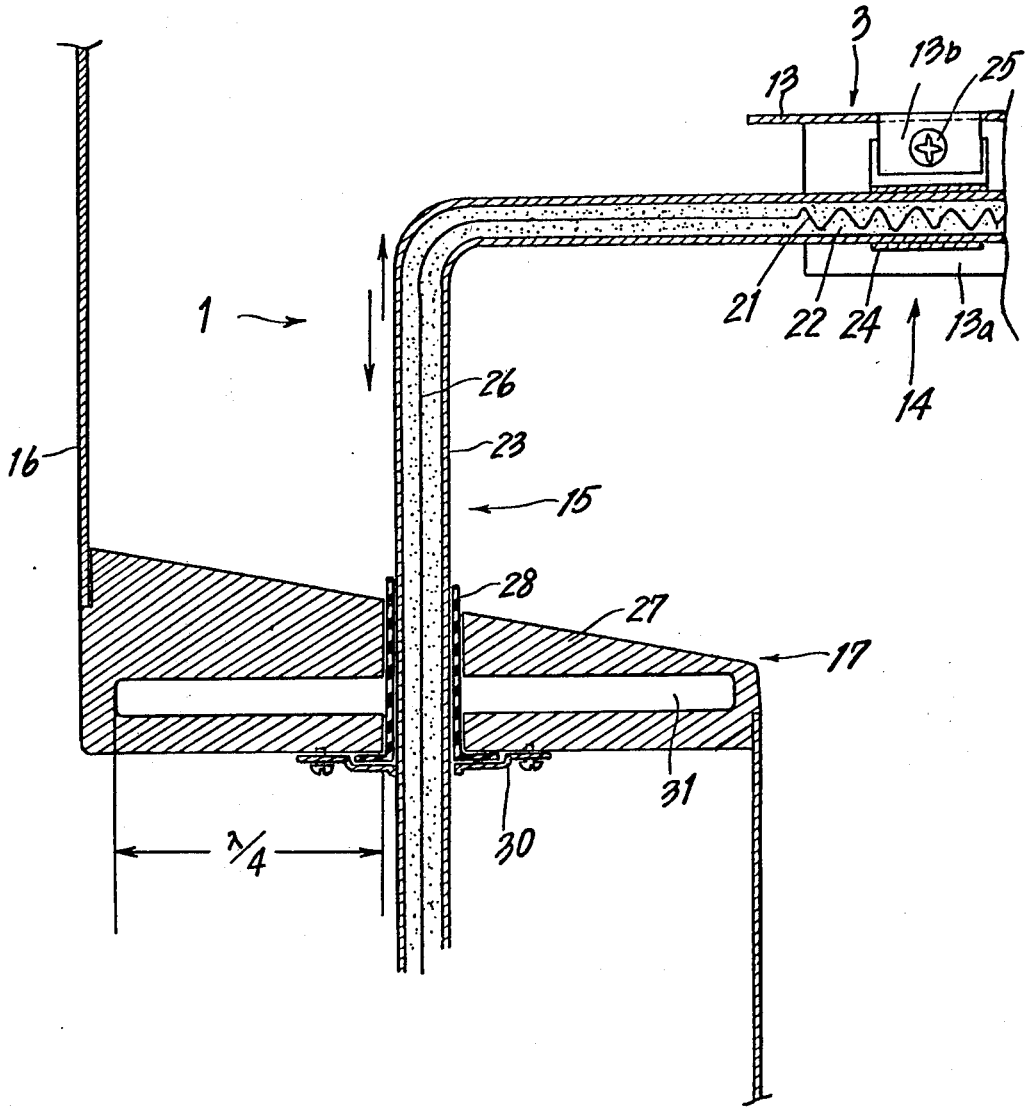
FIG. 4 is a sectional view of another embodiment of a leakage preventing mechanism suitable for the high-frequency oven of the present invention.
Figure 5:
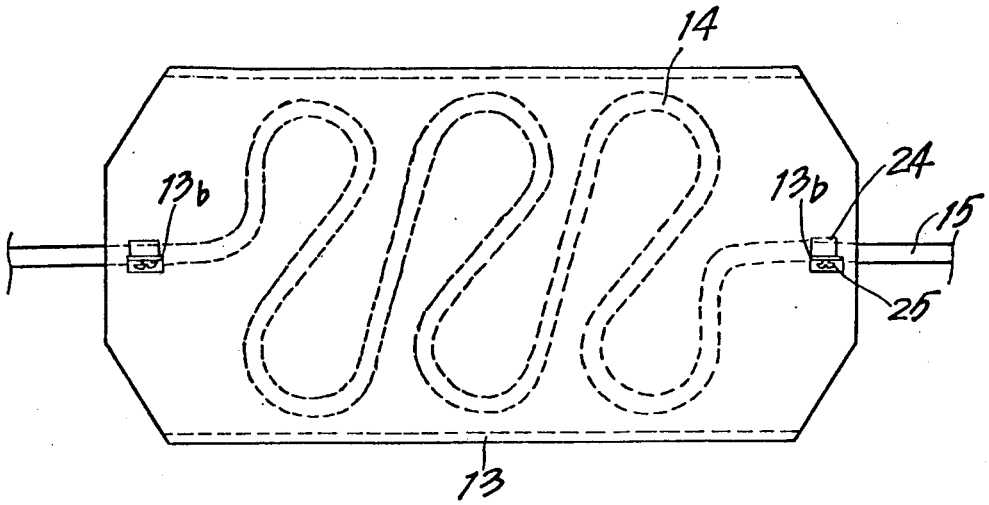
FIG. 5 is a plan view of a browning unit of the present invention.

Referring now to FIG. 4, there is illustrated another embodiment of the choke mechanism, wherein like elements corresponding to those of FIG. 3 are indicated by like numerals. In this embodiment the clearance 31 is provided perpendicular to the supporting pipe 15. The shielding effect against the microwave energy is superior to the embodiment of FIG. 3 but the choke mechanism of FIG. 4 occupies a larger size than in the embodiment of FIG. 3. FIG. 5 is a plan view of the browning unit 3. The sheath heater 14 is arranged in a serpentine fashion as already discussed above. A portion of the reflector plate 13 is cut and bent to form a pair of connection leaves **13*b***. Coupling between the sheath heater 14 and the holder 24 is achieved through the use of the welding technology. The reflector plate 13 is easily demountable since the screw 25 is unfastened outside of the high-frequency apparatus by the operator. This facilitates the cleaning of the reflector plate 13.

Figure 6:
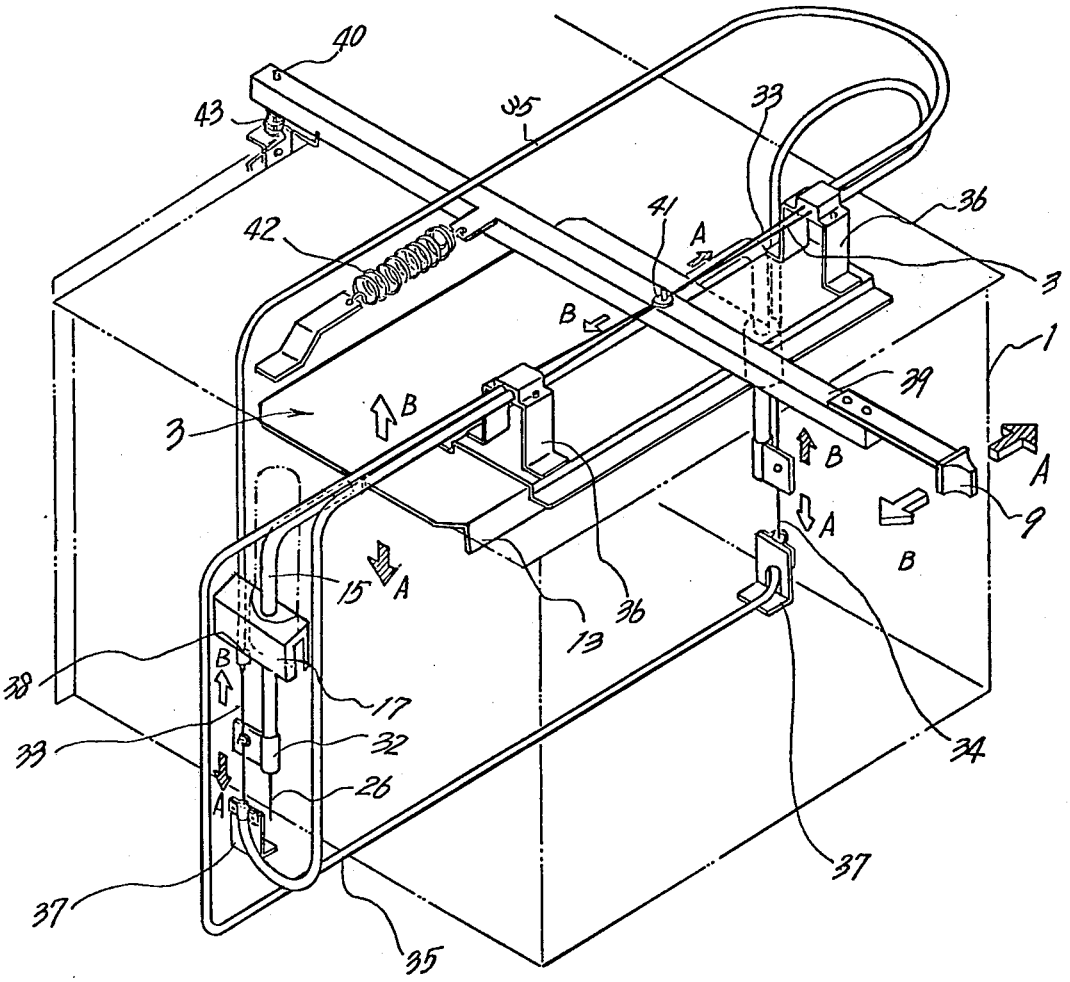
FIG. 6 is a perspective view showing a support mechanism for slidably supporting the browning unit of the present invention.

The slidable mechanism of the browning unit 3 will be described with reference to FIG. 6. A coupler 32 is provided at the end of the sheath 23 of the supporting pipe 15 and connected with a first support wire 33. The slidable lever 9 provided on the upper part of the front surface of the high-frequency apparatus is connected with one end of a bar 39, the other end of the bar 39 being rotatably fixed to the apparatus with the use of a pin 40. Therefore, the slidable lever 9 is slidable in a direction shown by the arrows A and B in unison with the bar 39. The first support wire 33 and a second support wire 34 are fixed to a middle point of the bar 39 with the use of a screw 41. The first support wire 33 is coupled to one end of the supporting pipe 15 via the coupler 32 as discussed above. The second support wire 34 is coupled to one end of another supporting pipe provided on the opposite side of the browning unit 3. The first support wire 33 and the second support wire 34 are coated with a flexible protector sheath 35 made of, for example, a coil spring except the coupling portions connected with the coupler 32 and the bar 39.

The flexible protector sheath 35 is fixed to upper angles 36 attached to the upper wall of the oven cavity 1, to bottom angles 37 attached to the bottom wall of the high-frequency apparatus, and to side angles 38 attached to the corresponding side walls of the oven cavity 1, thereby to support the first and second support wires 33 and 34. The first and second support wires 33, 34 are movable within the flexible protector sheath 35 and, therefore, the browning unit 3 is adjustable in height in the oven cavity 1 with the use of the slidable lever 9.

Both ends of a spring 42 are connected with the upper wall of the oven cavity 1 and the bar 39 at an appropriate point in order to support the browning unit 3 against its weight. The attraction force of the spring 42 functions to pull the slidable lever 9 in a direction shown by the arrow B, or to pull the browning unit 3 upward. Another coil spring 43 attached to the pin 40 functions to rotate the slidable lever 9 in a direction shown by the arrow A. The both springs 42 and 43 are effective to locate the browning unit 3 at a desired position.

When the operator shifts the slidable lever 9 in a direction shown by the arrow A, the first and second support wires 33 and 34 are shifted in a direction shown by the arrow A. The displacement of the support wires in the direction A causes the browning unit 3 to move downward via the coupler 32 and the supporting pipe 15. The supporting pipe 15 is smoothly shifted downward since the supporting pipe 15 is slidably supported by the insulating bearing 28. The microwave energy can not leak out by the provision of the choke mechanism 17. When the operator shifts the slidable lever 9 in a direction shown by the arrow B, the browning unit 3 moves upward in a same manner as discussed above.

The browning unit 3 can be stationally maintained at a desired position by virtue of frictional force caused by the slidable mechanism and the insulating bearing 28. A stop can be provided at a proper point to hold the browning unit 3 at a desired position.

When the browning unit 3 is positioned in the lower portion, the distance between the browning unit 3 and the foodstuffs becomes short and, therefore, the foodstuffs are browned hard. On the contrary, when the browning unit 3 is positioned in the upper portion, the foodstuffs are browned soft. It is effective to provide a plate with a mark indicating "soft ⇄ hard" along the slidable lever 9 on the front panel of the high-frequency apparatus.

Figure 7:
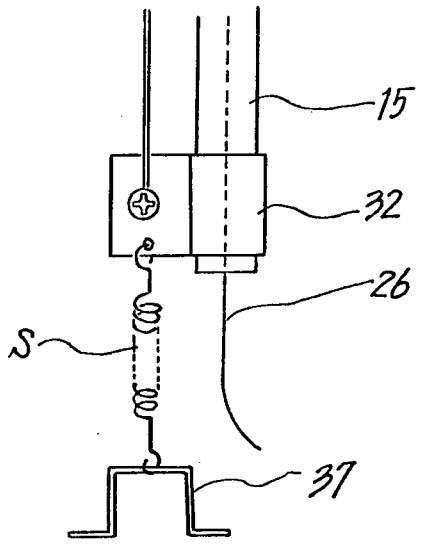
FIG. 7 is a front view of an essential part of another embodiment of a support mechanism of the browning unit of the present invention.

The supporting pipe 15 is maintained at a voltage potential identical with that of the oven wall via the coupler 32, the support wires 33 and 34, the bar 39, and the pin 40. The oven wall is electrically connected with the outside wall of the high-frequency apparatus, which is maintained at ground potential, and, therefore, the supporting pipe 15 and the sheath 23 of the heat generating means 14 are maintained at ground potential. There is created no possibility of the electric shock even though the operator comes into contact with the sheath 23 or the reflector plate 13 when the insulation between the heat generating resistance wire 21 and the sheath 23 is incomplete. FIG. 7 shows another embodiment of the support mechanism of the browning unit 3. In this embodiment a portion of the support wires is made of a spring. There is provided a spring S between the bottom angle 37 and the coupler 32, whereby the supporting pipe 15 is supported by virtue of elastic force caused by the spring S.

Figure 8:
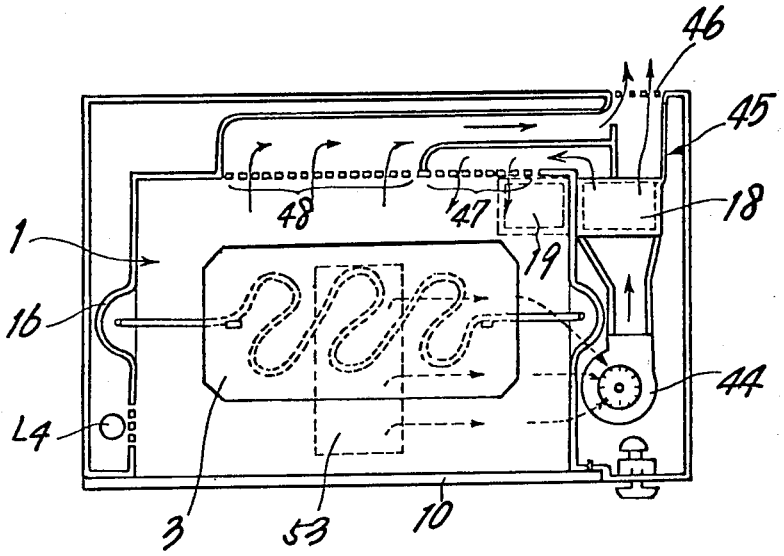
FIG. 8 is a plan elevation of a ventilating system of a high-frequency oven of the present invention.

Referring now to FIG. 8, there is illustrated a ventilating system for the high-frequency oven, a cooling fan 44 associated with a suitable driving means is provided for cooling the magnetron 18. A blow-off duct 45 comprises a blow-off aperture 46, a blast aperture 47 having a punching for conducting a part of the air flow passed through the magnetron 18 into the oven cavity 1, and an exhaustion aperture 48 having a punching for exhausting the heated air in the oven cavity 1 to the outside world through the blow-off aperture 46. Fresh air is supplied through an inlet port 53 provided on the bottom wall of the high frequency apparatus.

A portion of the air flow passed through the magnetron 18 is forced to flow into the oven cavity 1 and, therefore, the unnecessary temperature rise near the browning unit 3 is prevented. The heated air in the oven cavity 1 is conducted to the outside of the high-frequency oven by virtue of venturi effect caused by a major portion of the air flow passed through the magnetron 18. The exhausting air cannot be of an abnormal temperature since the heated air is mixed with the major portion of the air flow passed through the magnetron 18.

Figure 9:
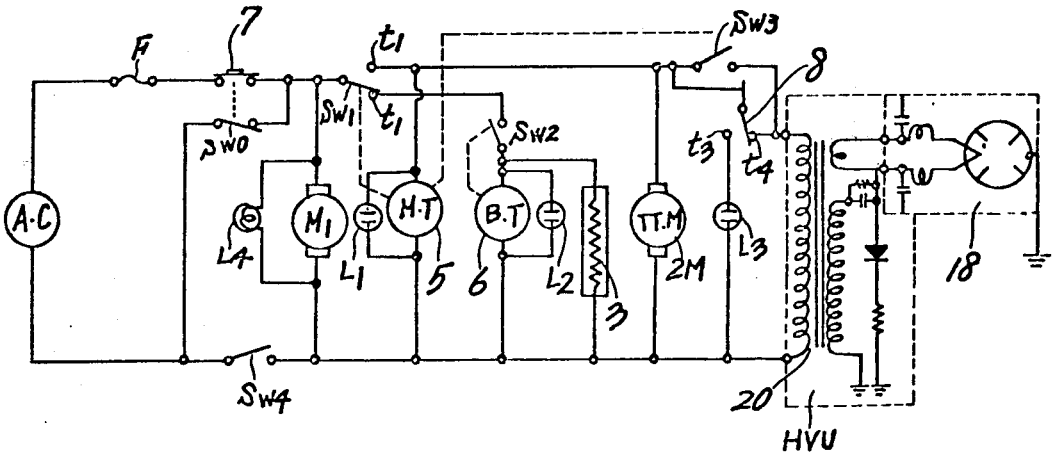
FIG. 9 is a schematic circuit diagram of a high-frequency oven of the present invention.

A typical circuit construction of the high-frequency apparatus is shown in FIG. 9. The apparatus is connected with a commercial A.C. power source A.C. via a fuse F. A monitor switch $SW_0$ is associated with the cook switch 7 in such a manner that the two switches are in the opposite states each other. A first control switch $SW_1$ is associated with the cook timer 5 in such a manner that the magnetron 18 is activated except when the cook timer 5 shows zero, and the browning unit 3 is energized only when the cook timer 5 bears zero and the browner timer 6 bears a value except zero. A second control switch $SW_2$ is associated with the browner timer 6 in such a manner that the browning unit 3 is enabled only when the cook timer 5 shows zero and the browner timer 6 shows any value rather than zero.

A third control switch $SW_3$ is coupled operatively with the cook timer 5 in such a manner that the third control switch $SW_3$ continuously performs its ON and OFF operation during a time period except when the cook timer 5 shows zero with the use of the conventional cam mechanism. The defrost control switch 8 on its ON state activates the defrost lamp $L_3$ and hence the magnetron 18 via the third control switch $SW_3$ to intermittently generate the microwave energy. A fourth control switch $SW_4$ is ON only when the door 10 is closed. A high voltage unit HVU comprising the transformer 20 is provided for power supply to the magnetron 18. A fan motor $M_1$ and the turntable motor 2M are provided for activating the cooling fan 44 and the turntable 2, respectively.

The fourth control switch $SW_4$ is ON upon closing of the door 10. The movable contact of the first control switch $SW_1$ is connected with a terminal $t_1$ upon setting of the cook timer 5. Afterward, when the browner timer 6 is set, the second control switch $SW_2$ is ON but neither the browner timer 6 nor the browning unit 3 is enabled. This is because the first control switch $SW_1$ is placed in the condition to enable the terminal $t_1$. When the cook switch 7 is depressed, the monitor switch $SW_0$ is OFF, the fan motor $M_1$ and the turntable motor 2M are energized, and the magnetron 18 and the cook timer 5 are continuously enabled since the movable contact of the defrost control switch 8 is in contact with a terminal $t_4$.

When the cook timer 5 shows zero, the movable contact of the first control switch $SW_1$ comes into contact with a terminal $t_2$. This results in that the browner lamp $L_2$, the browner timer 6 and the browning unit 3 are enabled. When the browner timer 6 shows zero, the second control switch $SW_2$ is OFF and, therefore, the browning unit 3 is disabled. When the opening lever 4 is depressed to open the door 10, the cook switch 7 is OFF and the monitor switch $SW_0$ is ON, respectively.

Figure 10:
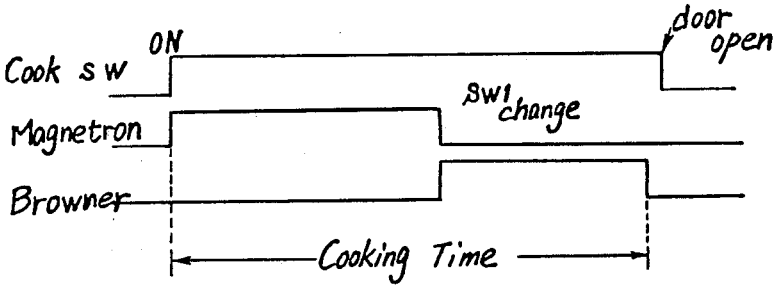
FIG. 10 is a time chart for the purpose of explanation of the cooking operation of the high-frequency oven of the present invention.

As discussed above, the microwave heating proceeds the browning operation in the high-frequency apparatus of the present invention. The operation mode will be more fully understood to those skilled in the art when considered with reference to FIG. 10 time chart. In this time chart, the defrost control switch 8 is not depressed.

The invention being thus described, it will be obvious that the same way be varied in many ways. Such variations are not to be regarded as a departure from the spirit and scope of the invention, and all such modifications are intended to be included within the scope of the following claims.

What is claimed is:

1. A microwave cooking apparatus comprising:

a. an oven cavity containing a means for supporting foodstuff, b. a magnetron operatively associated with said oven cavity for generating and introducing microwave energy into said oven cavity, c. a browning unit for browning foodstuffs contained in the oven cavity, d. a supporting member extending from the outside into the inside of said oven cavity for supporting the browning unit in said oven cavity, e. a shifting means operatively connected to said supporting member for shifting the position of the browning unit in the oven cavity relative to the means for supporting the foodstuff, f. a choke mechanism provided at the point of entry of said supporting member into the oven cavity, said supporting member passing through the choke mechanism, and g. an insulating member for slidably supporting the supporting member in the choke mechanism.

2. The microwave cooking apparatus of claim 1, wherein a slidable lever is provided on an outside wall of the microwave cooking apparatus and is connected to said shifting means, said shifting means being adjusted in height in the microwave oven cavity in response to the operation of the slidable lever, and a coupling means for coupling the supporting member to the shifting means outside the microwave over cavity.

3. The microwave cooking apparatus of claim 1, further comprising an indent provided in the side wall of the oven cavity, at the point where the supporting member passes into the oven cavity.

4. The microwave cooking apparatus of claim 3 wherein the choke mechanism comprises:

a. a metal block attached to the bottom wall of the indent, said metal block being adapted to receive said insulating member which in turn is adapted to slidably receive the supporting member, and b. a cylindrical channel provided within the metal block for preventing further leakage of microwave energy.

* * * * *